US007178513B2

(12) United States Patent
Ward

(10) Patent No.: US 7,178,513 B2
(45) Date of Patent: Feb. 20, 2007

(54) MCU BASED HIGH ENERGY IGNITION

(76) Inventor: Michael A. V. Ward, 32 Prentiss Rd., Arlington, MA (US) 02476

( * ) Notice: Subject to any disclaimer, the term of this patent is extended or adjusted under 35 U.S.C. 154(b) by 0 days.

(21) Appl. No.: 10/511,999

(22) PCT Filed: Apr. 19, 2003

(86) PCT No.: PCT/US03/12057

§ 371 (c)(1),
(2), (4) Date: Jun. 8, 2005

(87) PCT Pub. No.: WO03/089784

PCT Pub. Date: Oct. 30, 2003

(65) Prior Publication Data

US 2005/0241627 A1 Nov. 3, 2005

Related U.S. Application Data

(60) Provisional application No. 60/450,217, filed on Feb. 25, 2003, provisional application No. 60/432,161, filed on Dec. 10, 2002, provisional application No. 60/374,019, filed on Apr. 19, 2002.

(51) Int. Cl.
*F01F 38/12* (2006.01)
*F01F 38/14* (2006.01)

(52) U.S. Cl. ..... 123/634

(58) Field of Classification Search ..... 123/634, 123/179.5, 606, 620, 637, 643, 644
See application file for complete search history.

(56) References Cited

U.S. PATENT DOCUMENTS 5,101,803 A * 4/1992 Nakamura et al. ..... 123/634
5,632,259 A * 5/1997 Konda et al. ..... 123/634
5,844,786 A * 12/1998 Yoshida et al. ..... 363/21.01
6,142,130 A * 11/2000 Ward ..... 123/606
2005/0110604 A1* 5/2005 Fujiyama et al. ..... 336/90

* cited by examiner

*Primary Examiner*—Madmoud Gimie
(74) *Attorney, Agent, or Firm*—Jerry Cohen

(57) ABSTRACT

A high energy inductive coil-per-plug ignition system operating at a higher voltage Vc than battery voltage Vb by use of boost-type power converter (1), using high energy density low inductance coils Ti which are further improved by partial encapsulation of the coils and by use of biasing magnets (120) in the large air gaps in the core to increase coil energy density, the coils connected to capacitive type spark plugs, with improved halo-disc type firing ends, by means of improved suppression wire (78), the system operated and controlled by a micro-controller (8) to generate and control the coil charge time Tch, the sequencing the spark firing, and other control features including finding the firing cylinder by simultaneous ignition firing and sensing during engine cranking, to provide a highly controlled and versatile ignition system capable of producing high energy flow-coupling ignition sparks with relatively fewer and smaller parts.

28 Claims, 7 Drawing Sheets

FIG. 3d
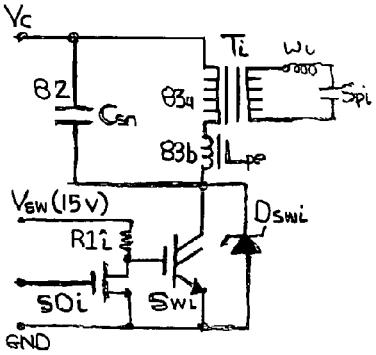
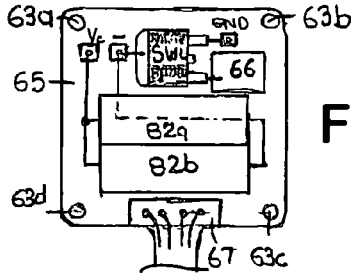
FIG. 3e
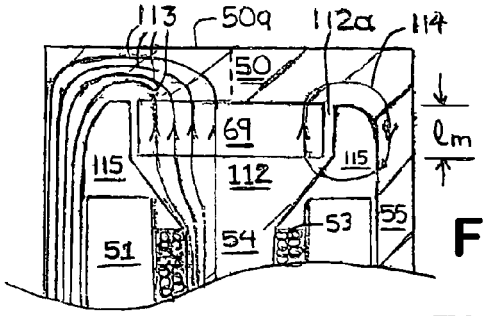
FIG. 4a
FIG. 4b
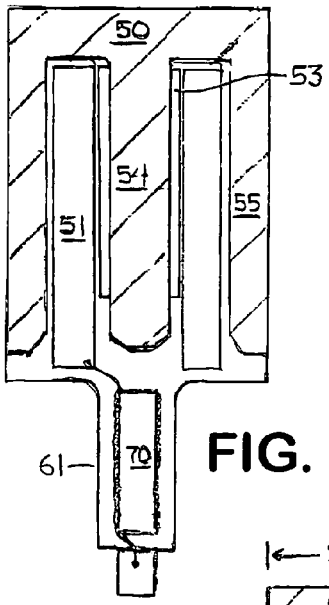
FIG. 4
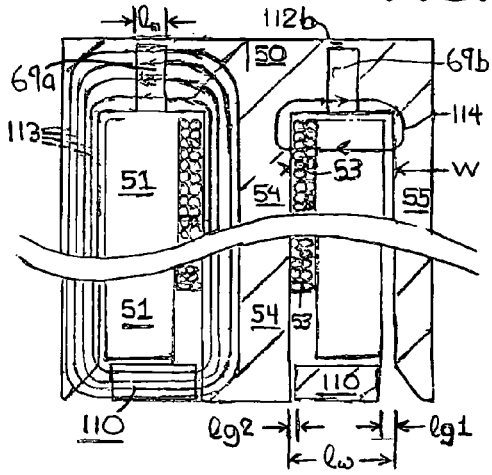
FIG. 4c
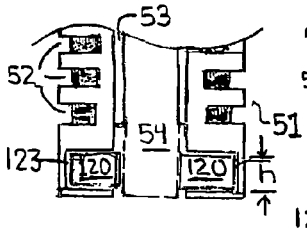
FIG. 5d
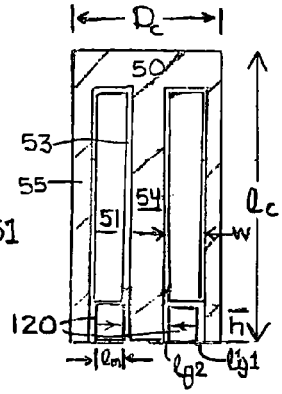
FIG. 5a
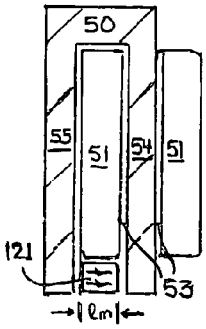
FIG. 5c
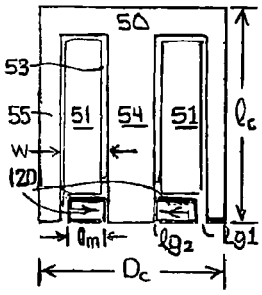
FIG. 5b Upconverting: S2 OFF (S OFF)
S1 ON/OFF Downconverting: S1 OFF
S2/S ON/OFF

MCU BASED HIGH ENERGY IGNITION

This application claims priority under USC 119(e) of provisional applications Ser. No. 60/374,019, filed Apr. 19, 2002; Ser. No. 60/432,161, filed Dec. 10, 2002; Ser. No. 60/450,217, filed Feb. 25, 2003.

FIELD OF THE INVENTION

This invention relates to an improved electronic coil-per-plug ignition system for spark ignition internal combustion (IC) engines, especially using higher energy density coils with biasing magnets, operating at higher battery voltage and current, uses with improved design capacitive spark plugs with erosion resistant halo-disc type spark firing ends, with improved suppression inductors and spark plug wire, to accommodate high energy flow-coupled ignition sparks, whose operation is controlled using a micro-controller (MCU) to simplify the design and improve the control capabilities of the system, including being able to operate the ignition without a phase or cam reference signal. As a complete ignition system applied to any spark ignition engine, it is capable of improving its fuel efficiency and exhaust emissions, especially under dilute mixture conditions such as lean burn and high exhaust gas recirculation (EGR).

BACKGROUND OF THE INVENTION AND PRIOR ART

This invention relates, in part, to a 42 volt based coil-per-plug ignition system as is disclosed in my U.S. Pat. No. 6,142,130, referred to henceforth as '130, to improve and simplify its operation and versatility, including improving and simplifying its electronic controls by use of an MCU, raising the energy density of its open-E type coils through the use of biasing magnets, improving the housing design of the coils to eliminate cracking due to thermal stresses, eliminating the need for a variable control (saturable) inductor to limit the secondary voltage upon switch closure, and other related improvements. The invention also relates, in part, to improving the electromagnetic interference and end-effect aspects of the ignition system disclosed in my U.S. Pat. No. 6,545,415, referred to henceforth as '415. Other aspects of the invention include improving the design of capacitive type spark plugs capable of handling the higher spark currents with reduced erosion, and improved low resistance suppression spark plug wire. In a preferred application, the ignition is used with a 2-valve, 2-spark plug per cylinder engine with squish flow, disclosed in my U.S. Pat. No. 6,267,107 B 1, referred to hence forth as '107, and improvements of it filed in a patent application with the same filing date as the present one. The disclosures of the above referenced provisional patent applications, and the '130, '415, '107 patents cited above, as well as those cited below, are incorporated herein as though set out at length herein.

SUMMARY OF INVENTION

This invention provides for an improved coil-per-plug ignition, as a complete system including ECU with micro-controller (MCU), ignitors, coils, spark plug wire, spark plugs, and other improved parts and features, which as a complete system is practical, low cost, compact and versatile, yet highly effective in providing flow-resistant ignition sparks with high spark energy for igniting lean and high EGR mixtures for better fuel efficiency with low emissions.

The ignition system has an ECU with features disclosed in my patent '130 and other improved features as a result of the use of an MCU which takes over the functions of creating the coil charging control (dwell control) by internally creating a dwell or coil charging period, which can be modified by sensing the coil charging current or by sensing any other engine parameters to control the coil energy. As part of the coil charging control, the ignition features ignition coil power switch enabling circuitry which applies power to the coil power switches Swi (preferably IGBTs) only during the coil charging time. The MCU also provides the ability to find the firing cylinder in a multi-cylinder engine through coil sensing and control means, and can provide RPM limiting (REV limiting), and other ignition features by making use of the MCU, with the minimum number of required electronic components.

For conventional 12 volt battery systems, versus the emerging 42 volt systems, the ECU includes a step-up power converter and voltage regulator for raising the voltage to a higher voltage, typically in the range of 24 volts to 60 volts, and preferably 42 volts as envisioned for the future. The power converter is preferably of the simpler boost type converter, versus the fly-back type disclosed in my patent '130, which can be used with one additional low-cost switch as a high power bi-directional converter for also stepping down the voltage, for example, from 42 volts to 14 volts as may be required in the future. A biasing magnet may be used in a special design of this converter, especially in the case of a high power bi-directional converter, to reduce the size of the magnetic core of the converter inductor.

Along with the ECU, the ignition may include Ignitor units with multiple-coils mounted on a single block, or stand-alone coils with power switches and related components mounted on a circuit board on the back of the preferred low-inductance E-core coils disclosed in my patent '130 and improved herein. These Ignitor units contain the ignition coil energizing and firing power switches Swi and their drivers and other components, including preferably the snubber capacitors of a snubber circuit disclosed in my patent '130. Alternatively, the snubber capacitors may be placed in the ECU with special ground return wiring to insure their proper operation. In the case of stand-alone coils, the capacitors are mounted on the circuit boards without use of the snubber circuit, wherein the coil leakage energy which is delivered to the capacitors is discharged across the primary coil winding.

The ignition coils, of the low inductance open-E type disclosed in my patent '130, are improved by using biasing magnets to double their already high energy densities, and making them circularly symmetric so they can be mounted more reliably on, or near the spark plugs, to be made more universally applicable. In the preferred embodiment, one or two biasing magnets are place in the air-gaps at the end of the preferred open-E type cores. For a cylindrical coil, an annular biasing magnet is placed in the annular air gap at one end of the coil. In the standard coil with laminations making up a square or rectangular core, two opposing magnets are paced in the air-gaps at the open end of the E-core.

The coils are improved to handle some of the practical issues relating to the wide temperature variations found in an engine environment, which can crack the coils in their epoxy encapsulated form due to different expansions coefficients of the coil constituents. In a preferred embodiment, the coil housing is designed so that only the center leg of the magnetic core is inserted in the housing (the outer legs being outside of the housing and free to make small sliding motions), and is designed to be able to slide as the expansion and contraction forces become high (due to extremes in temperature), to thus prevent cracking. The large temperature variations exist since the coils are preferably mounted on the spark plugs, or near the spark plugs.

Such very low inductance, inductive type coils can also be used in larger format for distributor type ignition systems, where the even shorter charge time Tch of preferably about 250 micro-seconds (usecs) eliminates the need for providing conventional ignition dwell, versus the "charge-and-fire" dwell, or charge time Tch feature of the present invention.

The suppression spark plug wire and inductors, including miniature size inductors and plug wire which can be placed inside the special design spark plug and/or in the high voltage towers of the ignition coils, and/or in between, are a novel design using iron or steel wire of high magnetic permeability which is spiral wound in a small diameter to form an inductive spark plug wire, or inductor, to provide a skin depth about equal to or less than the wire radius at about 1 MHz frequency, to provide significantly higher resistance, i.e. about ten times or more, above 1 MHz over the DC resistance to reduce electromagnetic interference (EMI) and the "end-effect" disclosed in my U.S. patent '415. The spark plug wire and inductors are designed to have a relatively lower inductance so that the frequency associated with the discharge of the coil output capacitance is between 5 and 20 MHz so that the higher resistance of the wire of hundreds of ohms or greater at that frequency is more effective in damping the oscillations across the wire and inductors and those associated with the end-effect. The spark plug wires and inductors are steel spiral over a magnetic core made up of a combination of ferrite and powder iron, or iron particles of the type used in particle core, or any combination of these.

The spark plugs disclosed herein are preferably of a flow-coupling type disclosed in my U.S. Pat. Nos. 5,517,961, 5,577,471 (referenced as '471), and '107 and are of the capacitive type disclosed in some detail in my U.S. Pat. Nos. 5,315,982, and 4,774,914, which are improved by using metallization to provide high capacitance of 30 to 80 pico-Farads (pF) in a compact design, with their electrodes made of erosion resistant material, such as tungsten-nickel-iron or other material, and with insulator preferably made of alumina strengthened with 20% zirconia. The plugs have an improved halo-disc type firing end disclosed in my patent '471, designed for varying level of spark gap penetration, and with a novel recessed insulator to reduce the chances of inadvertent interior firing while increasing the plug capacitance.

OBJECTS OF THE INVENTION

It is a principal object of the present invention to provide a coil-per-plug ignition, as a complete system including ECU with micro-controller to provide for a more compact and versatile system with ignitors that require fewer lower cost components, or stand-alone-coils which are more suitable for mounting on or near the spark plugs, and are more compact and robust using biasing magnets for more versatile mounting, and spark plug wire with better EMI suppression capability using steel wire, and spark plugs with high capacitance, low erosion and good flow-coupling capability, so that as a complete system the ignition is low-cost, easy to manufacture, practical, and compact, yet versatile and highly effective in providing flow-resistant ignition sparks with high spark energy for igniting lean and high EGR mixtures for better fuel efficiency with low emissions.

Another object is to simplify and reduce the size of the power converter by using a boost type converter for the DC-DC converter with simple control features.

Another object is to use the MCU in conjunction with sensing signals from the coils to determine the firing order of the ignition without the need for a phasing or cam signal.

Another object is to provide a housing design for the open-E type coil that is more robust under wide temperature variations by having the outer core section outside of the coil housing.

Another object is to provide circularly symmetric, even smaller high energy coils by using biasing magnets so they can be mounted on or near the spark plugs, yet still have high stored energy of approximately 100 milli-Joules (mJ) or higher.

Another object is to provide a bi-directional converter based on a boost type converter which is simple, low-cost, compact, with special inductor winding so that biasing magnets can be used to halve the size of the magnetic core.

Other objects of the invention will be apparent from the following detailed drawings of preferred embodiments of the invention taken in conjunction with the accompanying drawings.

BRIEF DESCRIPTION OF THE DRAWINGS

FIG. 3*d* is a preferred circuit drawing of the parts (excluding the coil) that are mountable on the PCB, which is shown in FIG. 3*e*.

FIG. 4 is an approximately 1½ times scale, partial side-view drawing of a preferred open-E type cylindrical coil with preferably laminated core. FIG. 4*a* is an approximately 2½ times scale, partial side-view drawing of the top end of an ignition coil with a biasing magnet located within a slot cut in the core of the center leg at the top end. FIG. 4*b* is a drawing of a coil similar to FIG. 4*a* but with two biasing magnets located in slots cut out of each side of the top end of the core. FIG. 4*c* is a preferred bottom section of the coils of FIGS. 4*a*, 4*b* with separate magnetic core at the bottom for completing the magnetic path for favorable operation of the biasing magnets.

FIGS. 5*a*, 5*b* and 5*c* are approximately to-scale, side view drawings of the low inductance ignition coils of the E-type and U-type, including biasing magnets which present large air gaps for the required low inductance, as well as allowing for smaller coil design for a high stored energy capability of approximately 180 millijoules (mJ) through the biasing action of the magnets. FIG. 5*d* is a partial side view drawing of a segmented secondary winding bobbin for containing the magnets of FIGS. 5*a* and 5*b*.

FIGS. 6*d* and 6*e* include suppression inductors interior to the spark plug insulators.

DISCLOSURE OF PREFERRED EMBODIMENTS

Figure 1:
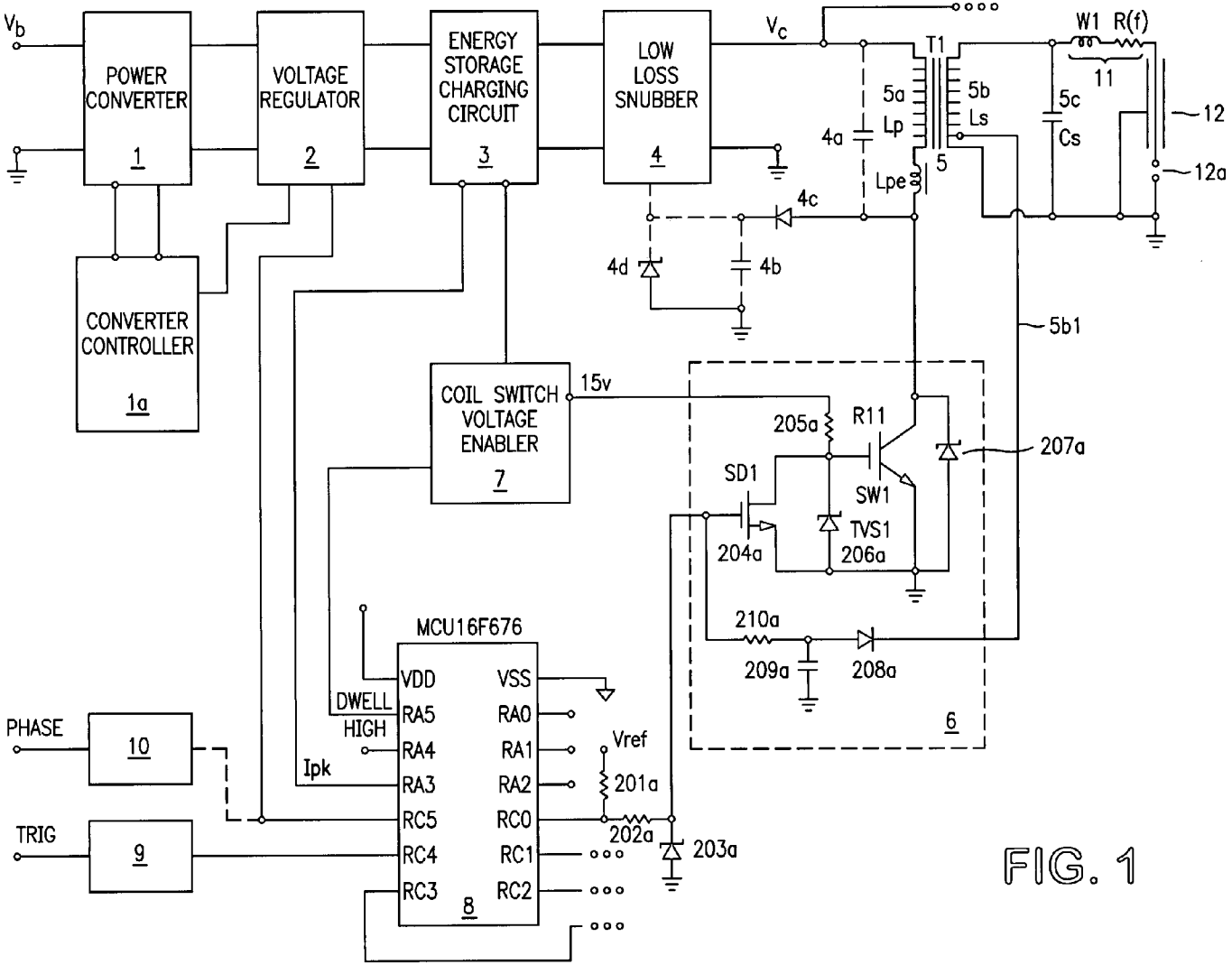
FIG. 1 is a partial circuit and partial block diagram of a preferred embodiment of the coil-per-plug ignition system showing one of several possible ignition coils with their driving and sensing circuits, which are shown controlled by an MCU, showing its various connections in terms of the special functions it performs.

FIG. 1 is a partial circuit, partial block diagram of the coil-per-plug ignition system made up of: power converter 1 and its controller 1*a*; voltage regulator 2; energy storage and coil charging and current sensing circuit 3; low loss snubber circuit 4 fully disclosed in my patent '130 and not repeated here; one ignition coil 5 of several possible (also designated T1 of Tn, or generically Ti); coil driving and sensing circuit 6 shown as a dashed block containing the key required components; a coil switch voltage enabler 7 which supplies the coil power switches Swi with power (15 volts designated) during their turned on (coil charging) duration Tch. The coil charging is controlled by an MCU 8, in this case shown as a 16F676 with 8 A/D converter input/output pins (RCO to RC3, RA0 to RA2, and RA4) for up to eight coils. Finally, there is the input trigger circuit 9, and the phase circuit 10 (a cam reference) available as an option to using coil sensing by the MCU 8 to find the firing cylinder. Blocks 1, 2, 3, 7, and 9 are shown in detailed circuit form in FIG. 1*a*.

If the snubber circuit 4 is implemented, then the snubber capacitor is located in the position designated as 4*b*, along with isolation diode 4*c* and voltage clamp 4*d*, whose operation is fully disclosed in my patent '130. Otherwise, snubber capacitor is placed across the primary winding 5*a* of coil 5, designated as 4*a* in this case, and operates by having the coil leakage Lpe energy stored on it upon coil switch S1 opening, discharged across the primary winding to deliver part of its energy to the coil secondary winding 5*b* and the spark, the rest of the leakage energy being dissipated in the coil windings and magnetic core.

Shown also in FIG. 1 is the coil 5 output capacitance 5*c*, of value Cs, which is typically a low capacitance of about 10 picoFarads (pF), the low value arising in part that the coil high voltage end is open, i.e. the magnetic core is open versus closed as in the standard inductive coil. This limits the high voltage capacitive energy discharged on spark firing to cause EMI. That energy is rapidly dissipated in the suppression spark plug wire or suppression inductor 11 with winding W1 with frequency dependent resistance Rs(f) whose resistance R(f) increases with frequency f, as disclosed in my patent '415 and improved herein. At the high voltage end is connected a preferably capacitive spark plug 12 of capacitance Cpl of 30 to 80 pF, as will be further disclosed. It has a spark gap 12*a* which is preferably approximately 0.060" when used with normally aspirated engines with compression ratio below 12 to 1.

Note that the term "about" is taken to mean within ±50% of the quantity it qualifies, i.e. about 10 pF means within 5 pF and 15 pF. The term "approximately", as used herein, is taken as within ±20% of the quantity it qualifies, i.e. approximately 0.060" means within 0.048" and 0.072".

Generically, the MCU performs several functions, the most important being taking the ignition firing trigger 9 and creating a charge time Tch (dwell) which is used to charge each coil sequentially, where the number of cylinders (assuming one coil per cylinder) is programmed into the MCU, so that once the proper firing sequence is determined, the charging signal circulates from pin RC0 to pin RC3 (shown in this case for a 4-cylinder engine) with each trigger signal. It is noted that only one coil and associated circuit are shown here. The same circuits apply to the other coils, controlled by pins RC1 to RC3, designated by ellipses.

In order to limit the size of the MCU, and the number of I/O pins, the pins RC0 to RC3, and additionally RA0 to RA2 and RA4 (for an 8-cylinder engine or a 4-cylinder with two coils per cylinder) are normally pulled high by pull-up resistors (201*a* shown in this case) to the reference voltage (typically 5 volts). They are then connected via a current limiting resistor 202*a* to the gates of switch driver N-type FET 204*a* (SD1 of SDn) whose gate is also connected to a 5 volt Zener 203*a* (corresponding to Vref). The drain of FET SD1 is pulled up to a higher voltage (15 volts shown) through slow-turn-on resistor 205*a* (R11), sufficient to turn-on the power switches Sw1 of Swn (IGBT shown). The drains of FETs SDi are connected to the gates of their respective IGBT power switches Swi (drain of SD1 connected to gate of Sw1 as shown).

A new feature is to use a large resistor for Rli, say 10K to 50K , depending on the capacitance, to slow the turn-on of the IGBT switches (which are preferable standard speed type IGBTs). This substantially reduces the voltage overshoot (voltage doubling) upon switch Swi closure to eliminate the need for the saturating inductor that is disclosed in my patent '130. Transient voltage suppressor (TVSi) diode 206*a* (TVS1) is connected across the driver FET switch SD1 for protection of the driver SD1 and power switch Sw1, as well as to provide additional capacitance to slow down turn-on of the power switches Sw1, i.e. TVS diodes have a high intrinsic capacitance. Otherwise, a separate capacitor may be used, or the smaller intrinsic capacitance of the IGBT power switches Swi my perform the function of slow turn-on in conjunction with the resistors Rli. The IGBTs Swi have a diode or clamp 207*i* (207*a* shown) across them as required.

An advantage of the this MCU based ignition with A/D converters, is that the MCU can be used to find the firing cylinder (search mode) without a phase reference, by bringing out a lead 5*bi* (5*bl* shown) from each coil that includes a few turns of the coil 5 secondary winding 5*b* at the low voltage end of the winding, e.g. that includes about 0.005 times the secondary turns Ns, e.g. 20 turns for Ns equal to 4,000, and connecting the wire to a sensing circuit. The sensing circuit in this case is shown associated with MCU pin RC0 comprising diode 208*a*, capacitor 209*a* (e.g. 22 nanoFarad (nF)), and resistor 210*a* (e.g. 100K) for pull-up resistor 201*a* approximately equal to 3 K. The sensing circuit works by firing all the coils simultaneously during engine cranking (MCU pins RC0 to RC3 go from output low (coil charging) to output high (spark firing), to input for sensing after the spark has fired and the capacitors 209*i* (209*a* shown) are fully charged (initially negative in this case for the typical coil negative high voltage, followed by a positive voltage which can also be used). With the above component values, the sense voltages range from 4.5 volts to just above zero for −5 kV to −30 kV. The voltages on the pins are then A/D converted, compared, and the lowest voltage one designated the fired cylinder (highest cylinder pressure, highest negative voltage, and lowest positive sense voltage). For verification, the process can be repeated to insure that the next sense low is the expected one (next in the firing sequence). It is noted that Pin RC5 can be used to lower the output voltage Vc, e.g. from 42 to 28 volts, to limit to peak coil output voltage upon switch Swi closure during cranking-and-sensing to prevent false spark plug firing.

Pin RA3 is used to sense the coil charging current as an override protection in case the current exceeds some threshold Ith, e.g. 36 amps for a normal 30 amps peak current Ipk for a coil primary inductance of approximately 330 microHenries (uH), i.e. for atypical coil stored energy of approximately 150 millijoules (mJ). This is achieved for a typical preferred coil primary turns Np equal to 50 and an open E-core cross-sectional area of approximately 1.0 square centimeter (sq.cm) and approximately 0.6 sq.cm with biasing magnets, where "equal to" means within ±10% of the quantity it qualifies, i.e. Np between 45 and 55. For this preferred embodiment, the coil charge time Tc is approximately 0.3 milliseconds (msec). When the current exceeds the threshold current Ith, Pin RA3 goes low and terminates the MCU internally generated dwell or charge time Tch. During the cranking-and-sensing stage (search mode), the input RA3 is disabled, since the current will be approximately 2½ times over the normal, e.g. 80 amps instead of 30 amps, i.e. 4 times 30 times (28/42) assuming Vc is 28 volts versus 42 volts at cranking.

If a phase 10 reference operation is preferred instead of the search mode, this can be accomplished by tying, for example, now undedicated Pin RC5 to the phase output, and sensing for a low or high. It is noted that once the firing cylinder is sensed and the engine is running, the phase input is not required until the engine is stopped and restarted.

In the automotive application where 42 volts (or higher voltage) is available for the present higher voltage based ignition, a power converter may not be required. In that case, switch Sw1 of coil 5 (T1) preferably has a current sense resistor (48 of FIG. 9) between the emitter of switch Sw1 and ground, also acting as a fuse, connected to a sense circuit connected to the MCU. In this case, if a switch Swi should become disabled by shorting (the sense resistor/fuse is opened), the other coils will still function and the engine can still operate in a "limp mode".

Figure 1A:
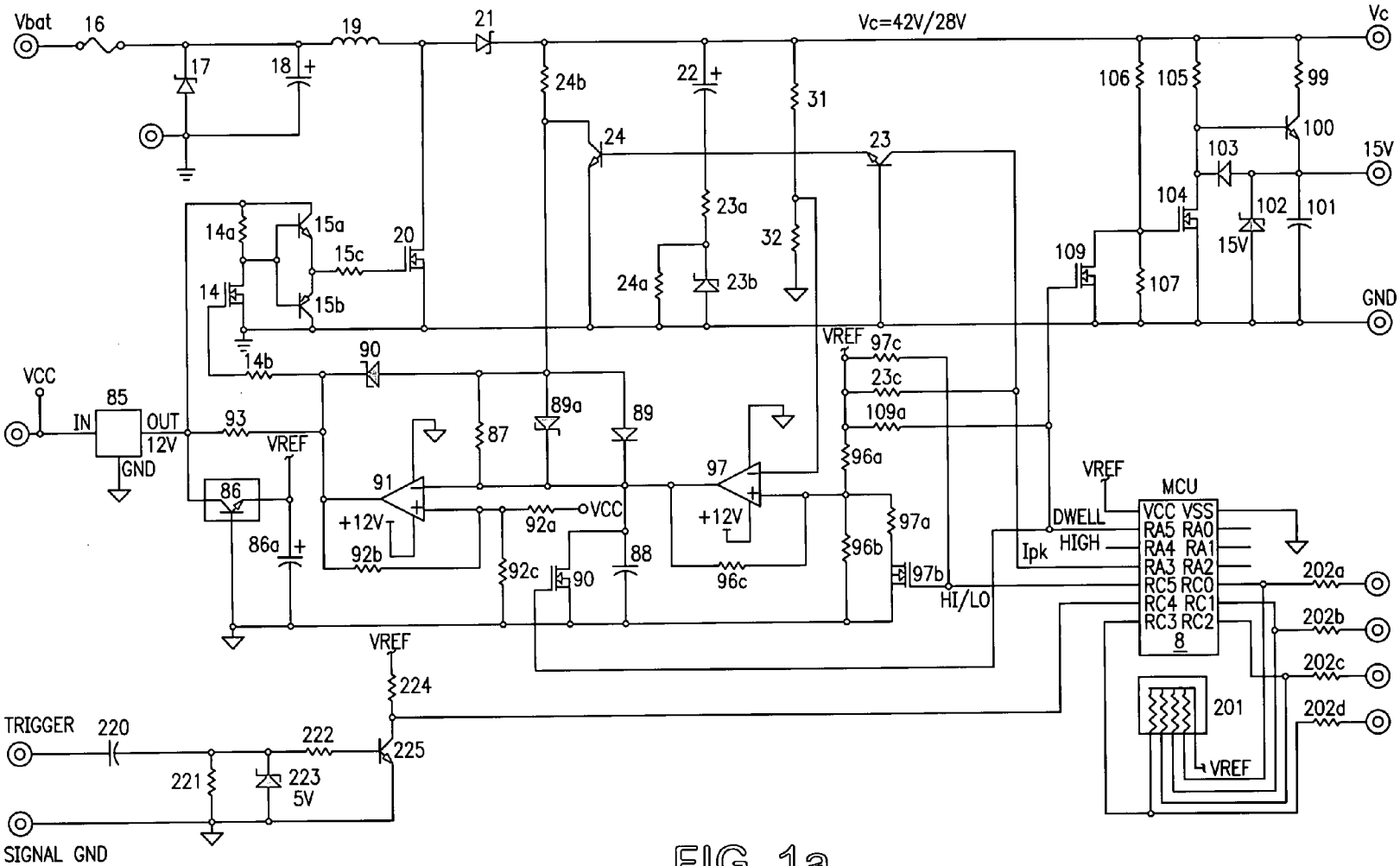
FIG. 1*a* is a detailed circuit drawing of the system of FIG. 1, excluding the ignition coils and their drivers and power switches which are shown in detail in FIG. 1.

FIG. 1*a* is a detailed circuit drawing of the system of FIG. 1, excluding the actual ignition coil and its drivers and power switches, which are shown in detail in FIG. 1. Also the sense circuits are also not shown as they have been disclosed in FIG. 1.

In the present application, for the power converter 1 is shown a boost converter comprised of an input filter capacitor 18 connected to a voltage supply Vb, e.g. a car battery, input over voltage protection clamp 17, typically 30 volts, boost inductor 19 (of inductance Lb of preferably about 40 uH), N-type FET switch 20, and boost output diode 21, which typically will be a 60 volt Schottky. Operation of this converter is well known to those versed in the art, and in this application the preferred frequency of operation is about 60 kHz, i.e. between 30 klHz and 90 KHz.

The converter controller drives switch 20 using the totem pole NPN and PNP transistors 15*a*, 15*b*, controlled by N-type FET 14 with pull-up resistor 14*a*, controlled output of comparator 91 which controls FET 14 through resistor 14*b*. Operation of this oscillator controller circuit is essentially identical to that of FIG. 10 of my patent '130, and host of the component numerals of that application, i.e. 87 to 97, correspond to those that have been used in this drawing to designate similar components and operation, i.e. resistors 87, 92*a*, 92*b*, 92*c*, 93, timing capacitor 88, and diode 89. In addition, there is included Zener 89*a* to reduce the switch 20 on-time at high voltages, e.g. Vcc of 20 volts. Optional N-type FET 90 is placed across timing capacitor 88 to disable it (turn off power converter) during coil charging time Tch when Pin RA5 goes high (during Tch).

Resistor divider 96*a* and 96*b* set the reference voltage of the regulator comparator 97, which in this case can be lowered during cranking to lower Vc to, say, 28 volts, if sensing is used. This is done by having MCU Pin RC5 go high which turns on N-type FET 97*b* (with base pull-up resistor 97*c*) to place resistor 97*a* across resistor 96*b*, and lower the reference voltage. The signal to the inverting input of comparator 97 is taken from the regulator divider 31, 32.

Resistor 24*b* for charging timing capacitor 88, with associated components NPN transistor 24 and resistor 24*a* control the peak current of the boost converter, where transistor 24 senses the converter output current flowing through energy capacitor 22, where the value of resistor 24*a* is typically at least 10 times greater than 23*a*, which may simply be a foil on the circuit board of resistance about 5 milli-ohms. For a 50 watt power converter operation, preferred value for resistor 24*a* is approximately 0.15 ohms. Operation of this off-time control is disclosed in patent '130, although the topology is different since this is a boost converter versus flyback.

The purpose of the high current Schottky diode 23*b*, with negative temperature coefficient, is to allow sensing of both the capacitor charging and discharging current, providing a voltage drop on discharging, e.g. 0.5 volts at 30 amps, so that with resistor 23*a* sense NPN transistor 23 (whose collector is normally high via pull-up resistor 23*c* connected to regulator voltage Vref) can perform the coil charging control already mentioned. That is, the collector of sense transistor 23 goes low when the charging current exceeds a threshold, e.g. 36 amps, as would occur if the coil secondary output should fire during coil charging, to signal the MCU to terminate coil charging. The collector is shown connected to input pin RA3 of the MCU to provide the control feature.

A simple trigger input conditioning circuit is shown with its output connected to Pin RC4 of the MCU. It is made of three resistors 221, 222, 224, a 5 volt Zener, and a NPN transistor, with output normally high, and the trigger signal to Pin RC4 being a pull to ground whose duration is less than Tch. Operation of this circuit is well known to those versed in the art.

Shown also in FIG. 1*a* is a circuit for providing the IGBT gate voltage Vg (typically 12 to 15 volts) for the IGBT power switches Swi, in a controlled way. Shown is NPN transistor switch 100 with its collector connected to resistor 99, e.g. 1K to 3.3K, which is connected to the source voltage Vc, and its emitter is connected to a parallel combination of capacitor 101, of typical capacitance 33 nF to 0.1 uF, and a Zener 102 which sets the gate voltage Vg. Between point Vg and base of transistor 100 is discharge diode 103 which is connected to both the drain of a control N-type FET transistor 104, whose source is grounded, and to a resistor 105 (typically 22K) which is connected to Vc. FET transistor 104 has its gate connected to a resistor divider 106, 107, with the gate terminal being the control terminal operated by N-type FET 109 which is turned on during the coil charge time (MCU Pin RA5 goes high). Transistor 100 provides the IGBT drive voltage Vg, depending on whether transistor 109 (with pull-up resistor 109*a*) is on or off. In this way, the drive voltage to the gates of the power IGBT switches Swi can be enabled or disabled by the MCU. Preferably, when the reference voltage (5 volts shown) drops, to say 3.5 to 4.3 volts, as would occur on engine turn-off, drive voltage Vg can be turned-off to prevent uncertain firing of the power switches Swi when the MCU goes into a low-voltage mode with uncertain pin conditions. In addition, the trigger signal Tr can be used to enable Vg during coil charging (switch Swi on) and to disable it when the switches are turned off. In this way, an MCU protection override is provided for the power switches Swi. Alternatively, in a passive mode where control is not required for Vg, transistor 100 is eliminated (shorted), the value of resistor 99 is increased, and all the other components are eliminated other than capacitor 101 and the Zener 102.

In FIG. 1*a* is also shown the pull-up resistors (block 201) of the MCU 8, and the output current limiting resistors 202*a* to 202*d* for the output control Pins RC0 to RC3. The MCU can also run a 4-cylinder engine with two coils (and plugs) per cylinder, which can be independently fired by using the four extra MCU pins. Also shown are 12 volt regulator 85 and 5 volt regulator 86 and its load capacitor 86*a*.

The MCU can perform many other functions, for example, increasing the coil and spark energy for a period of time after starting by increasing the coil charging time, from say a nominal 180 mJ to 225 mJ, and then reducing the energy further to say 150 mJ when the temperature rises above a defined level by sensing, for example, the voltage across a thermistor, as is known to those versed in the art. It can also REV limit by simply putting in a delay after ignition firing, e.g. 5 msec for 6000 RPM for a 4-cylinder engine.

Figure 2A:
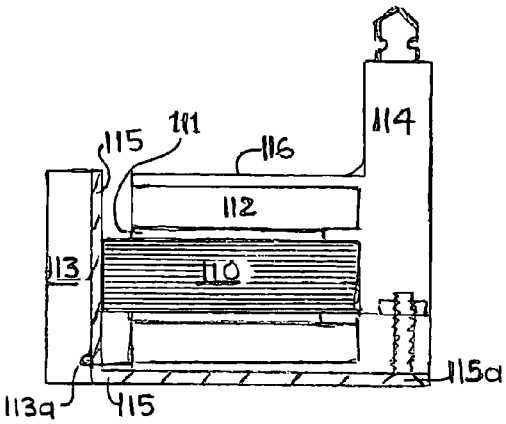
FIGS. 2*a* to 2*c* are approximately to-scale drawings of the side, end and top views of the open-E type ignition coil with laminated core with the preferred feature of having the outer core legs outside of the coil housing.
Figure 2B:
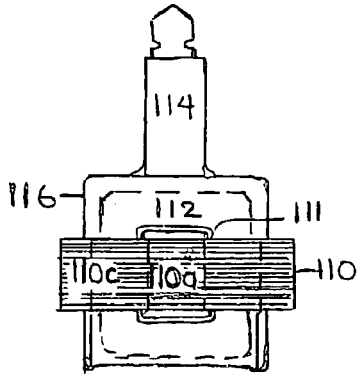
Figure 2C:
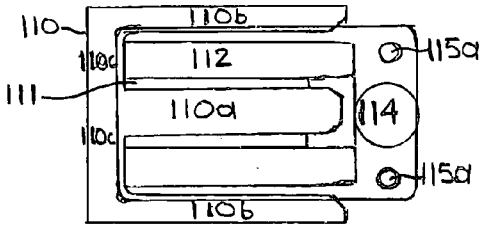

In the current application using preferably coils with open-E type magnetic cores, as disclosed in my patent '130, a preferred type of such coil with stored energy capability in the 150 to 200 mJ range is shown in FIGS. 2*a* to 2*c*, which are approximately full scale, depending on the stored energy. FIG. 2*a* shows a partially detailed side view of such a preferred coil, with E-core 110, primary and secondary winding sections 111 and 112 respectively, with the Ignitor unit 113 mounted on the back for mounting the power switch Swi and related components, and a high voltage tower 114. The coil and Ignitor may be mounted on an "L" bracket as part of an assembly of coils, as discussed, shown here as part 115, which can be metallic to ground the core, or insulating, with mounting holes 115*a*. The wires from the coils are indicated as 113*a*, which ideally emerge from the coils as windings ends and are directly soldered onto the board within the Ignitor housing 113.

A key feature of this variant of the E-core is that the laminations are mostly outside the housing 116, i.e. only the core center leg 110*a*, shown in the end-view FIG. 2*b* and top partial view FIG. 2*c*, is within the housing, and it is designed so that it can move, i.e. it is not firmly encapsulated in the housing. The outer legs 110*b*, FIG. 2*c*, are outside the housing, as is the back end 10*c*. In this way, with temperature variations, the laminations can move relative to the housing to minimize the chances of cracking. However, the laminations must be held together to the housing, which can be done with a flexible glue, e.g silicone, or by use of a bracket 115 shown. Preferably, the secondary winding 112 is segmented, with number of bays, typically 6 to 10 bays.

Figure 3C:
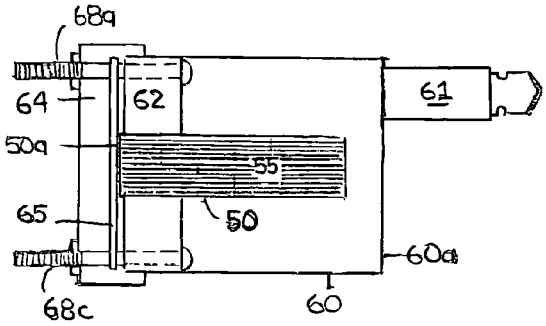
FIGS. 3*a* to 3*c* are approximately to-scale drawings of the open-E type ignition coil with laminated core with the outer core legs outside of the coil housing whose main body is cylindrical in shape, depicting two side views, one including a printed circuit board (PCB) and component housing mounted on its back, and an end view showing the structure on which is mounted the PCB.
Figure 3A:
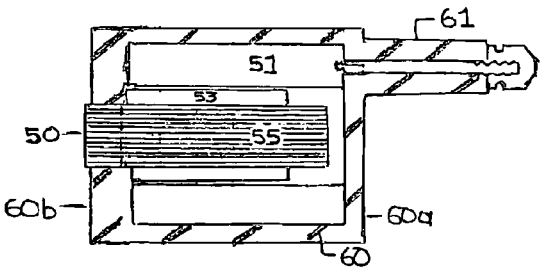
Figure 3B:
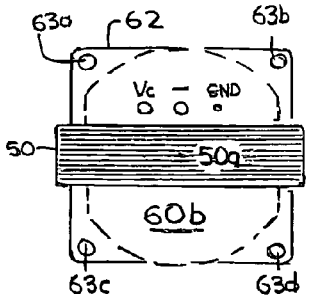

FIG. 3*a* is an approximately to-scale side-view of an ignition coil of the type of FIGS. 2*a* through 2*c*, including the high voltage tower 61 which in an axial direction in this case. The core is of the preferred open-E type design whose center leg (not shown) is inside the coil housing and whose outer legs 55 are outside the housing. FIG. 3*b* is the back end view of the coil of FIG. 3*a* showing the clamping mount 62 with four mounting and clamping holes 63*a* to 63*d*, and the primary wire ends, designated as Vc and—, and the secondary winding low voltage winding wire end designated as GND (for ground), with the opening 60*b* shown as a dashed curve. In this case, the possible sense winging is not shown. In this design, the housing 60 is essentially cylindrical, sealed at the high voltage end 60*a* and open at the low voltage end 60*b* into which the windings, bobbin and core center leg are inserted, and into which the encapsulant, e.g. epoxy, is introduced. FIG. 3*c* is an approximately to-scale, side-view of the ignition coil of FIG. 3*a* including a rear housing 64 in which is a circuit board 65 on which are mounted the coil power switch Swi and driver components, and wherein the underside of the board is ground and is clamped against the end of magnetic core 50 to ground it and keep it firmly in the housing 60. The board 65 and rear housing 64 are clamped onto the coil housing clamping mount 62 against the core end 50*a* (see FIG.3*b*) by means of bolts 68*a* to 68*d*, which also serve for mounting the entire coil unit to a frame.

FIG. 3*d* is a circuit diagram of parts, including power switch Swi, driver SDi and resistor Rli, for mounting on the back of the ignition coil (FIG. 3*c*), with a preferred circuit board 65 shown in FIG. 3*e*, which includes snubber capacitors 82*a*, 82*b* which eliminate the need for extra wire and the snubber circuit (four wires shown on connector 67). In this design, with reference to FIG.3*d*, the snubber capacitor means Csn (82) is connected across the coil primary winding designated as an ideal transformer winding Lp (83*a*) with leakage inductor Lpe (83*b*). As normal, upon ignition firing, leakage current flows to the snubber capacitor 82, but in this case it oscillates back through the primary winding where it dissipates rapidly by delivering its energy to the spark and to the magnetic core and windings. In this way, the clamp Dswi (preferably internal) across the switch Swi does not have to dissipate power, and is only there to limit open circuit voltage. Also, the EMI is reduced in this design (versus with no snubber capacitor). With reference to FIG. 3*e*, preferably two parallel polyester high voltage capacitors are used. They can be located across the board as shown (82*a*, 82*b*), or if they are shorter, they can be placed across the board (at right angles of those shown), to provide more room for the section 66 where the drive components are located.

FIG. 4 is an approximately 1½ times scale, partial side-view drawing of a preferred form of the open-E core type cylindrical ignition coil showing the magnetic core with center leg 54, outer legs 55, and back end 50, with the primary 53 and secondary 51 winding sections, and an electromagnetic interference (EMI) suppression inductor 70 within its high voltage tower 61. Preferably the windings and center leg are contained in an insulating cup 60 (not shown) with the outer legs 55 of the magnetic core located outside the cup. Preferably the magnetic core is made of laminations, whose cross-section can be square or rectangular defining a close to perfect cylindrical coil housing 60 (not shown). For a rectangular cross-section of the magnetic core, preferably the ratio of the sides is approximately 1.3 in terms of the long side to the short side to help achieve an essentially cylindrical housing 60. For equal magnetic stressing of the outer core legs 55 to the inner core 54, the sum of the cross-sectional areas of the two outer legs should equal 85% of the inner leg 54, the 15% reduced factor coming from the reduced area of the center core 54 corners which are preferably rounded by using narrower width laminations on the outside, and from the fact that some magnetic flux in the center leg will leak and not pass through the outer legs 55.

Figure 7A:
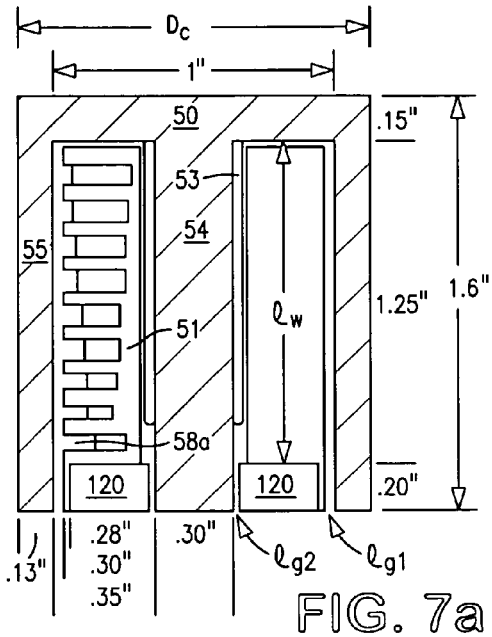
FIG. 7*a* is a twice-scale, partial side view drawing with preferred dimensions of the magnetic core, secondary winding bobbin, and biasing magnets of FIG. 5*b*.

The coil design shown is of particularly low inductance Lp, e.g. approximately 300 uH, with primary winding Np of approximately 50 turns, turns ratio Nt of approximately 70, and bobbin 51 for winding the secondary wire with preferably 9 bays, i.e. 8 to 10 bays, as indicated in FIG. 7*a*. The output capacitance Cs of this coil is reduced by having the primary winding 53 extending short of the center leg core 54, e.g. approximately 80% of its length, and having the secondary winding 52 in the segmented bobbin 51 extend at or beyond the ends of the core center leg 54 and outer leg 55. Coil peak output voltages are typically 36 to 40 kV.

FIG. 4*a* is an approximately 2½ times scale, partial side-view drawing of the top end of an ignition coil with a biasing magnet 69 located within a slot cut in the core of the center leg at the top end made up of transition section 112 and top section 50. FIG. 4*b* is a drawing of a coil similar to FIG. 4*a* but with two biasing magnets 69*a* and 69*b* located in slots cut out of each side of the top end of the core 50. FIG. 4*c* is a preferred bottom section of the coils of FIGS. 4*a* and 4*b*, shown associated with FIG. 4*b* in this case, which has a separate magnetic core 110 at the bottom end for completing the magnetic path and for allowing favorable operation of the biasing magnets. For the preferred coil stored energy Ep of 100 mJ to 200 mJ, the preferred overall dimensions of the laminations are from equal to 1" across for a pencil type coil, to approximately 1¼" across for others. The length can vary from about 1" to 2", or longer depending on application. Like numerals represent like parts with respect to FIGS. 3*a* to 3*c*.

The design of the coil of FIG. 4*a* assumes the core to be made up of open-E laminations as per FIG. 3, except for the center leg 54 fanning out at the top to create transitional section 112 above which a rectangular slot is cut of dimension just less than the maximum width of the section 112, defining narrow channels 112*a*. The slot is for inserting the biasing magnet 69. The two narrow end sections 112*a* allows the laminations to maintain themselves as a single structure, but forces most of the magnetic flux lines 113 to pass through and along the complete magnetic path or circuit, versus short circuiting as flux line 114 which passes through the air-section 115 as flux leakage.

FIG. 4*b* represents a simpler form of open-E lamination where two biasing magnets 69*a* and 69*b* are placed vertically in the end section 50 symmetrically about the middle. This is done by cutting two rectangular vertical slots of height just short of the full height of the end section 50 to accommodate the magnets 69*a*, 69*b*, creating narrow end sections 112*b*, which as in FIG. 4*a*, keeps the lamination as a single structure, but forces most of the magnetic flux lines 113 to pass through the along the complete magnetic path or circuit, versus short circuiting as flux line 114 to represent flux leakage. In this case, the top flux leakage section is width "w"of the entire coil lamination winding window. Like numerals represent like parts with respect to the earlier figures.

Since the biasing magnets represent air-gaps of length "slm", it is not practical to have an open end at the bottom of the magnetic core, as in FIG. 3, since this will lead to high magnetic flux leakage of the biasing magnet and overly low coil primary inductance Lp. But since we want to maintain the advantages of using a single open-E core, separate magnetic core sections 110 are placed at the bottom as shown. These may introduce small air gaps lg1 and lg2, as shown, but as long as their sum is much less than the core window width "W", i.e. preferably less than half of W, then the leakage will be small.

More generally, we can write:

$$W > 2\Sigma lgi$$

where the sum is taken over all the air gaps in the magnetic path (excluding the magnet). In addition, we require for a low inductance coil that:

$$W \approx lm + \Sigma lgi$$

which resembles an open-E core in terms of the total air gap that an open-E presents.

FIGS. 5*a*, 5*b* and 5*c* are approximately to-scale, side view drawings of the low inductance ignition coils of the open-E-type and U-type for an assumed approximately 150 mJ stored energy (and scaled accordingly for lower or higher stored energy), using biasing magnets to achieve the very high energy density, which present large air gaps for the required low inductance and high energy density (mJ/gm). Like numerals represent like parts with respect to the previous figures.

FIG. 5*a* is an open-E type coil of the pencil type, i.e. the magnetic core length lc is approximately twice or more than the core diameter of width Dc; and open-E coil of FIG. 5*b* is a cylindrical type coil where the length lc is less than twice the width Dc. Both coils (FIGS. 5*a*, 5*b*) have biasing magnets 120 at the bottom open ends as shown, which are preferably two separate magnets for use with flat laminations. They can be a single ring type magnet if the center leg is essentially round, which can also be achieved with laminations whose center legs 54 are of various widths, preferably of three widths of the ratios 0.89, 0.72 and 0.44 of the circle diameter, to achieve a fill factor of over 80%, or of more widths.

For two separate magnets, the magnets would have a cross-sectional area Am (at right angles to the magnetization direction) 50% to 100% greater than the cross-sectional areas of the outer legs 55, assuming the use of high grade magnets with magnetic flux densities of 1 Tesla or higher and high coercive force, such as NdFeB or SmCo, and a magnetic length lm to essentially fill the end air gap (which equals the winding width W). However, if the preferred cylindrical type cup 60 (not shown) is used for the coil wherein the center leg 54 is in the cup, and the outer legs 55 are outside the cup, then there will be a small air-gap lg1 of about 0.050" (depending on the thickness of the cup wall adjacent to the magnet 120). A very small air gap lg2 will also exist on the inside to allow the center leg 54 (which is preferably wrapped with insulation) to slide freely.

There are several advantages of this design, other than that of using the biasing magnet to achieve a higher magnetic swing up to twice normal. One is that the magnets do not disturb the end air-gaps used to achieve the preferred low inductance. Another is that the magnets are separate from the laminations, so that the do not interfere with the small sliding movements of the core legs allowed with temperature change to prevent cracking of the epoxy or other material used to encapsulate the windings. That is, the center leg 54 is wrapped with an insulation, which is encapsulated with the windings, but the center leg can slide inside the insulation (along with the outer legs 55 which are free to move) under thermal stress caused by differing expansion coefficients between the core material, the encapsulation, and the one or more winding bobbins. Another advantage is that the flux lines at the bottom of the core sections 54/55 tend to bend towards the surface of the magnets 120 for less leakage flux.

In the design of FIG. 5*a*, the width Dc can equal 1" (0.9" to 1.1") and the length lc can be approximately 2" for a stored energy of approximately 160 mJ. The narrower and longer winding window can be accommodated by using flattened (rectangular) magnet wire in a free-standing structure, i.e. without a bobbin, which is also preferred for other compact coil structures. For example, a primary winding equal to 50 turns (45 to 55 turns) of flattened copper magnet wire of 20 AWG (American Wire Gauge) can be used with a winding length lp equal to 1.5" and a wire thickness of approximately 0.02".

In the design of FIG. 5*b*, the width Dc is approximately 1.3" and the length lc is approximately 1.6" for a stored energy of approximately 180 mJ. The window width W is typically up to 40% greater than the center leg 54 width, typically approximately 0.36"; the core cross-section can be round, square, or rectangular with side ratios of approximately 1.3, as already mentioned. Preferably, approximately 50 turns of wire (Np) in two layers are used for the primary winding 53, of winding length (lp) approximately 1". The magnetic flux swing achievable through the center leg 54 with the biasing magnets is approximately −1.6 Tesla to approximately +1.6 Tesla to provide a high energy density.

FIG. 5*c* is a similar design as the E-cores but using an open-U core with open end on the bottom where a single biasing magnet 121 is used. All other things being equal, the magnet cross-sectional area Am is approximately twice the cross-sectional area of the two legs 54, 55 (which are approximately of equal cross-section). Also, as with the E-cores, the U-core design preferably has the windings 51/53 and the leg 54 about which the windings are wound in an insulating cup (not shown) with the outer leg 55 outside the cup. The leg 54 is preferably insulated and free to slide within the insulation with temperature change, as discussed with reference to FIGS. 5*a* and 5*b*.

In all three cases, preferably approximately 50 turns of two layers of primary wire are used, typically 19 to 21 AWG, which are round but also can be flattened, for a preferred primary inductance of approximately 330 uH and peak primary current of approximately 32 amps, for coil stored energy Ep of 100 mJ to 250 mJ for automotive applications. Typical secondary to primary turns ratio Nt is approximately 70 for use with 600 volt IGBTs, and approximately 80 for use with approximately 450 volt IGBTs.

FIG. 5*d* is a partial side view drawing of a segmented secondary winding bobbin 51 for containing the magnets 120 of FIGS. 5*a* and 5*b*. Shown are the last three slots 52, as well as the region 53 where the primary winding 53 locates and the magnetic core center leg 54. As is seen, two large interior slots 123 exist on the inside end of the bobbin where to magnets 120 are inserted. Since the magnets are located to repel each other they will stay in the slots against their back wall to allow the center leg 54 to slide freely past their inner face. The magnets 120 and slots 123 are designed to produce minimum air gaps lg1 and lg2, typically 0.05" for lg1 taking the wall thickness of the cup 60 into account, and about the same for lg2. For the applications of FIGS. 5*a* and 5*b*, the magnet height "h" is approximately 0.20", its length lm is dictated by the coil window width W, and its other dimension made to conform to the size of the core side, which for a an approximately coil stored energy of 150 mJ will typically range between 0.25" and 0.5", depending on application.

While the preferred primary inductance Lp and peak primary current Ip are approximately 300 uH and 32 amps, other values are possible using the designs of FIG. 4*a* to 5*c* which have large air gaps (where the magnets are located). For example, assuming a primary turns of 60 and a primary winding length well short of the window length lw, e.g. for lw=1.25", lp=1.0", then a primary inductance Lp of 500 uH is easily achievable, which taken with a peak primary current of Ip of 25 amps provides a coil stored energy of 155 mJ, and for a turns ratio Nt of 70, a peak spark current of350 ma, which is above the 200 ma required for ignition flow coupling but produces less spark plug erosion than the 450 ma spark current with the lower inductance higher primary current cases already discussed. Note that the inductance Lp not only depends inversely on the winding length lp, but on the length lp relative to the winding window length lw, i.e. the smaller lp/lw, the higher the inductance; it also depends on the location of the winding, which preferably is located against the back 50 of the core, i.e. for higher Lp and less magnetic fringing fields beyond the open bottom end. However, too short a length produces non-uniform magnetic stress.

Figure 6A:
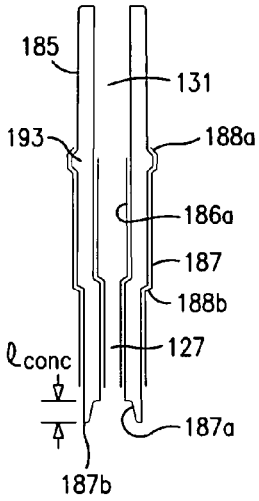
FIGS. 6*a* and 6*b* are approximately to-scale, side-view drawings of insulators for capacitive spark plugs for the preferable halo-disc plugs of FIGS. 6*c*, 6*d*, 6*e*, and 6*f*, made of alumina or zirconia strengthened alumina to give a higher dielectric constant, and with internal and external metallized surfaces for the capacitance, and with concave versus convex insulating ends for larger diameter center electrodes with a higher capacitance.
Figure 6B:
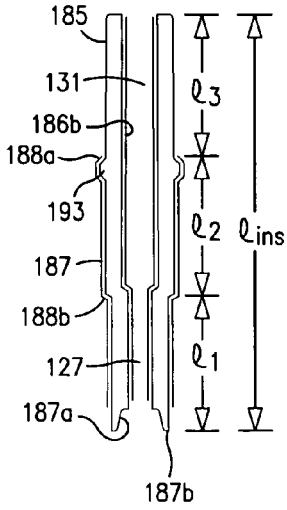

FIGS. 6*a* and 6*b* are approximately to-scale, side-view drawings of insulators for capacitive spark plugs for the preferable halo-disc plugs of FIGS. 6*c*, 6*d*, 6*e*, and 6*f*, made of alumina, or zirconia strengthened alumina to give an approximately 50% higher dielectric constant, and with internal and external metallized surfaces for the capacitance. The two insulators are identical except for the length of metallization on the inside surface.

The length of the insulator "lins" is made up of three length sections 11, 12, 13 of overall length approximately 3.0 inches, 11 defining the section along the threaded shell section 125 (FIG. 6*c*), 12 defining the section along the non-threaded remaining shell section 188, and 13 defining the top insulating tower section 185. The inner surface of the insulator of FIG. 6*a* is metallized (186*a*) along the bottom length sections 11 and 12, i.e. along the entire metallic section of the spark plug, just short of the bottom end; the inner surface of the insulator of FIG. 6*b* is metallized along its entire length 186*b* as indicated, just short of the bottom end. In both cases, the outside surface 187 is metallized along the length defined by l1 plus l2, the region where the elongated outer metallic shell case 188 is located, again just short of the bottom end. The insulator thickness along lengths l1 and l2 are approximately 0.10", sufficient to withstand the high voltage without puncturing, but thin to give the maximum capacitance per unit length. The metallization of the surfaces can be done by various means, but is most readily and cheaply accomplished by a chemical process where copper is deposited by an electroless process after treatment, i.e. seeding of the surfaces. Preferably, the electrical contact between the outer metallization and the shell 188 is made at the top end 188*a* where the metallic shell is folded over the boss 193 to make a seal, and at the section 188*b* where the inner diameter of the shell has a step.

With reference to FIGS. 6*a* to 6*f*, anew feature of the insulators, designed specifically for the halo-disc type plug which prefers the insulator end to be recessed below the slots or cut-outs 126, as per my U.S. Pat. No. 5,577,471, ('471) is having a concave 187*a*, i.e. Hollow, versus convex end, whose depth "lconc" (FIG. 6*f*) is such to prevent tracking, but not longer than needed, e.g. approximately 0.2". The advantage is that it allows for a larger diameter center bore 127 for a large bottom center "cooling" conductor 127*a* for better conducting heat away from the center electrode tip 128, and it allows for the building higher capacitance along the shell threaded section 125 by having a thinner insulator wall of approximately 0.10", as already mentioned. The cooling conductor diameter is between 0.12" and 0.18" for an interior shell diameter "Dshell" between 0.35" and 0.4" for a 14 mm spark plug. Preferably, conductor 127*a* is of high thermal conductivity material such as copper or brass. Its erosion resistance is not important since a center high voltage erosion resistant electrode 129 will be attached directly to it, as in FIG. 6*d*, or with some kind of fastener, e.g. nut 129*a*, which can also act to lock the center electrode 127*a* into place with the larger diameter end 130 working with it to create the lock.

Figure 6C:
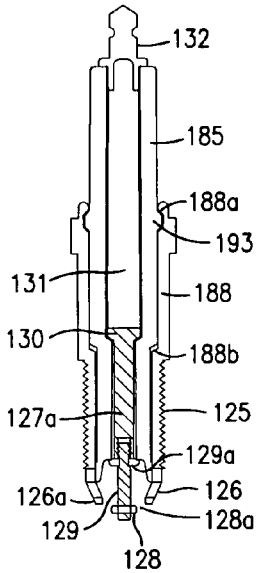
FIGS. 6*c* to 6*e* are approximately to-scale, side-views of capacitive, halo-disc plugs improved by using the insulators of FIGS. 6*a*, 6*b*, which accommodate larger diameter, better heat sinking center electrode at the bottom section of the plugs.
Figure 6D:
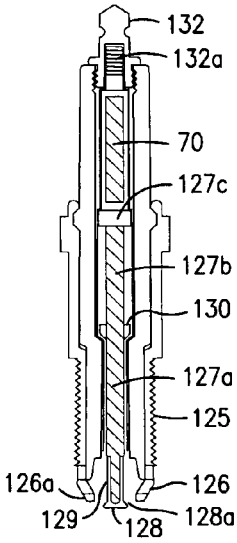
Figure 6E:
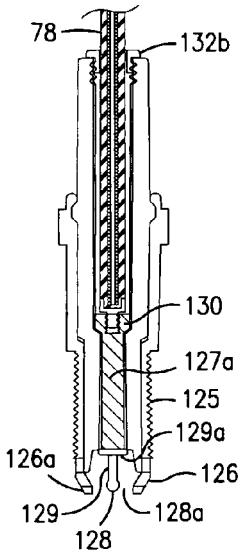

FIG. 6*c* shows one version of the spark plug, where the bore 131 can be empty, or filled, for example, with powder to help make the seal of the center conductor. The high voltage tip 132 can be soldered to the inner metallization (assuming the insulator of FIG. 6*b* is used), or threaded on as shown in FIGS. 6*d*, 6*e* (where the insulator inner diameter (ID) contains a thread as shown). An essentially cylindrical end electrode 128 is attached to a supporting electrode 129 which is welded or threaded (as shown) to the center conductor 127*a*. The insulator upper outer diameter (OD) preferably conforms to the standard 31/64" with the ID (bore) being approximately 0.2" smaller (of approximately 0.1" thick insulator).

If a slim-line plug is required, then the OD will be made smaller (with some loss of capacitance). However, as an option, one can have each of the OD and ID of the entire insulator be of one diameter along their outer and inner entire lengths, other than the sealing boss 193, e.g. the OD equal to 0.38" and the ID equal to 0.17". The inner seal can be made by having the electrode 127*a* (which could now not have the larger diameter section 130) be of a uniform diameter and extend into section 13 where its would be thinned to, say, 0.1" to allow for a powder seal, and designed to contact the tip or nipple 132, with the nipple in turn making electrical contact with the inner metallization 186*a*. If the bore 131 ID can be made uniform, then the inner metallization may not be needed, with the capacitance formed between the extended length cooling conductor 127*a* and the uniform shell ID along 11 and 12. Or the electrode can be thinned along 12 and 13 and the bore 131 filled with conductive powder, e.g. brass, for both a seal and for providing the capacitance.

FIG. 6*d* shows another version of the spark plug with the insulator of FIG. 6*a*, where the center conductor 127*a* has an extension 127*b* over the length 12 around which powder can be filled to make the seal, with an electric field diffuser 127*c* placed at the end of the inner metallization 186*a* to eliminate the effect of the sharp edge (and hence otherwise high electric field). Between the diffuser and the tip 132 is an EMI suppression element 70, which contacts the tip 132 by means of a spring 132*a*. The suppression element 70 can also be a length of the special spark plug wire of FIG. 8*b* contained in a semi-rigid structure which terminates at the diffuser 127*c* and tip 132.

In place of the inner metallization 186*a*, or in conjunction with it, conductive, e.g. brass, powder can be placed around the cooling conductor extension 127*b* (along section 12) and tamped to make both the inner seal as well as the capacitance along that section 12. Also, with reference to the firing end electrode 129, which is shown without a fastener to attach it to cooling electrode 127*a*, the cooling of tip 128 can be further improved by having a copper core inside of the end electrode 129. This can be done by having the end electrode 129 and its tip 128 made up of a shell or coating placed over a small diameter, e.g. approximately 0.08", extension of the cooling electrode 127*a*, for drawing the heat even more efficiently from the firing end 128, which produces the high temperature spark (arc discharge) and is exposed to high temperature gases by preferably being placed deeper into the combustion chamber for better ignition flow coupling. Preferably, all the surfaces of the cooling electrode and its extension (particularly its extension) are covered to not be directly exposed to the spark and combustion gases. Finally, with respect to this figure, the absence of a fastening unit 129*a* reduces the chances of tracking and fouling of the surface of the inside of the insulator 187*a*.

FIG. 6*e* is yet another version of the spark plug with integral suppression spark plug wire 78, where the spark plug wire is located in the insulator bore along its entire length, shown making a contact with the center conductor end section 130 (shown as a threaded contact). The advantage of this design is that it gives the maximum use of the plug bore length l2+l3 for the suppression spark plug wire 78. The top fastening element 132*b* at the end is an electric field diffuser (if insulator of FIG. 6*b* is used) contacting the end of the metallization section, and also serving to hold the spark plug wire in place from moving. The spark plug wire 78 is clearly insulated from the metallization 186*b*.

All three spark plugs of FIGS. 6*c*, 6*d*, 6*e* have some or all of the elements of a halo-disc type firing end structure disclosed in my U.S. Pat. No. 5,577,441, wherein the ground electrode is made up of a convex annular structure with slots 126 cut in them (shown in an expanded view in FIG. 6*f*), to provide a firing ring end 126*a*, into which may be located an erosion resistant sub-ring 126*b*, such as tungsten nickel iron, iridium, or other (or it may be a coating or plating of erosion resistant material).

The center electrode 128 is preferably a cylindrical structure (FIGS. 6*c*, 6*d*) located beyond the ground ring 126, or inside the ring as in FIG. 6*e*. In order to insure firing between the electrode 128 and the ground ring 126*a* (or 126*a*/126*b*), the ID of the threaded shell section 125 is the maximum diameter Dshell that canbetolerated, preferably between 0.36" and 0.40", without having too weak a wall especially at its top junction which is stressed during frightening. In this way, assuming a diameter equal to 0.10" for the electrode 129 and 0.38" for the shell ID along the treaded section 125 Dshell of FIG. 6), the clearance between the electrode 129 to the inner shell wall is 0.14", or approximately twice the preferred spark gap 128*a* of typically 0.06" to 0.08" for normally aspirated gasoline engines. If two plugs are used per cylinder, as per my patent '107, one plug may have a large gap, e.g. 0.08" for firing only under light load conditions, while the other has a small gap, e.g. 0.04", to handle the higher load conditions. For the large gap plug, it is even more important to have the large interior clearance to insure firing at the exterior spark gap 128*a*.

Figure 6F:
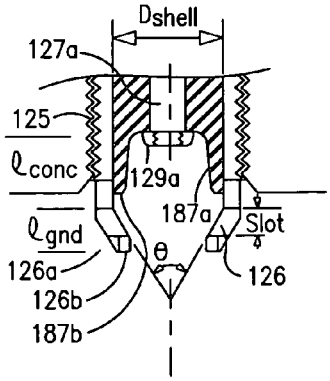
FIG. 6*f* is a twice-scale side view drawing of the spark plug shell ground firing end, excluding the center firing electrode, showing more details of the insulator and shell firing end.

In addition, with reference to FIG. 6*f* (no central electrode shown), the included angle θ varies to define the level of the spark gap extension by having the convex ground section of length "Ignd" be shorter or longer, the larger or smaller the angle respectively, varying between 30° for a long extension of plug firing end, and 90° for a short extension of firing end, However, because of the flow-coupling nature of the ignition, by definition, an extended gap type plug is preferred (small angle θ). The slot axial clearance also vary with the angle θ (extension), typically from ⅙" to ⅛, or somewhat longer.

There are typically three or four slots cut around the annulus, four being the preferred number in this case for balancing the radial electric field to the posts that support the ring 126*a* (see U.S. Pat. No. 5,577,471). The preferred length land is approximately 0.2" and the angle is approximately 40°. The four slots are cut at every 90° preferably with a tapered cutter to produce an inner post width equal to the outer to avoid sharp interior points. Also, all inner metallic surfaces are smoothed for reducing electric field concentrations to prevent interior firing versus firing at the spark gaps 128*a*, 128*b*. The concave insulator end 187*b* terminating near the inner edge of slots 126 has side walls 187*a* that are of a thickness to survive the harsh environment, but sufficiently thin to accommodate a sealing nut or other fastener if required, as indicated by 129*a*, which can seal the center electrode 129 to the cooling conductor 127*a*.

The high voltage electrode end 128 is made of erosion resistant material such as tungsten-nickel-iron, iridium or other, or a thick plating of such. The remaining electrode 129 can be any used in spark plugs, or of the same material as the tip. The plug capacitance Cpl is preferably 30 to 60 pF, defined mainly by the length of the shell spark plug shell 188 (including most of the treaded section 125), thickness of the insulator, and its dielectric constant. The entire spark plug end of center conductor 129 and ground ring can be plated with catalyst material such as palladium to enhance combustion reactions.

While the emphasis of the above plug designs has been on the halo-disc type plug end, the capacitance nature of the plug can apply equally well to conventional plugs with the long nose insulator at the firing end, with various electrode structures, including those disclosed elsewhere for firing to the piston. In addition, the convex insulator end can be conventional, or can be recessed if used with the halo-disc design of my patent '471.

Figure 7B:
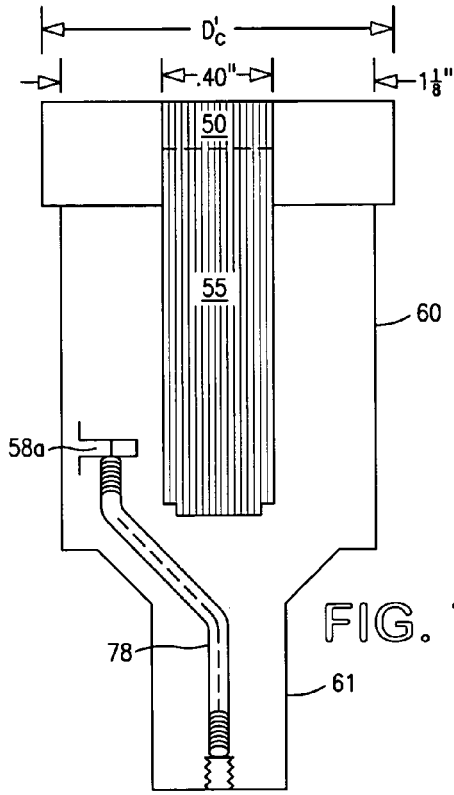
FIG. 7*b* is a twice scale partial side view of the preferred housing for the coil of FIG. 7*a*.
Figure 7C:
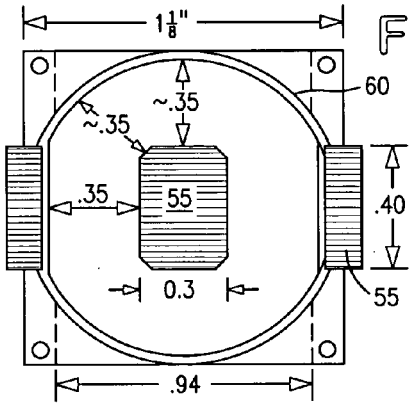
FIG. 7*c* is a twice-scale partial top end view of a slice of the core of FIG. 7*a* depicting a preferred rectangular laminated core.
Figure 7D:
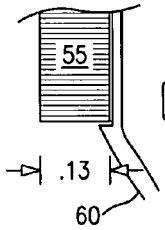
FIG. 7*d* is an expanded view of a small section of FIG. 7*c* showing an inside corner of the housing and outer laminations.

FIG. 7*a* is a twice-scale, partial side view drawing with preferred dimensions of the magnetic core, secondary winding bobbin, and biasing magnets of FIG. 5*b*. FIG. 7*b* is a twice scale partial side view of the preferred housing for the coil of FIG. 7*a*, rotated by 90°. FIG. 7*c* is a twice-scale partial top end view of a slice of the core of FIG. 7*a* depicting the preferred rectangular laminated core similar to FIG. 3*a*. FIG. 7*d* is an expanded view of a small section of FIG. 7*c* showing an inside corner of the housing and outer laminations. Like numerals represent like parts with respect to FIGS. 3*a* to 5*d*.

In FIGS. 7*a* to 7*c*, the preferred dimensions are assumed to be ±10%. FIG. 7*a* shows the preferred dimensions for a stored energy of approximately 180 mJ using high grade magnets such as Neodymium (NdFeB), with overall length of 1.6" dimension with expected width dimension Dc of 1.26" based on the 1" dimension shown for the center leg and windows (0.3"+2·0.35"). This lamination can be made, with adjustments within±10%, from the EI-3/8-LP laminations, by opening up the window and trimming the width dimension Dc from 1.375" to, say. 1.3", if necessary. The bobbin shown is a preferred type segmented bobbin, with 9 bays appropriately dimensioned and filled appropriately with wire (shading) to handle the progressively higher voltages with position towards the bottom high voltage end. The last bay 58*a*, which is shown extended beyond the primary wire 53, has a deeper slot, as indicated, and relatively fewer turns of wire. The bobbin also has two interior slots to locate the magnets 120.

In FIG. 7*b* is shown a central high voltage tower 61 with flexible suppression wire 78 terminating at one end in the last bay 58*a* of a preferred segmented bobbin 51 (FIG. 7*a*). The tower can equally well be on a side so that the suppression wire 78 is brought out essentially straight. The two dimensions shown correspond to those of FIGS. 7*a* and 7*c*.

FIG. 7*c* shows a rectangular laminated core for use in a design of FIG. 5*a* with preferred dimensions of 0.3" and 0.4" forth rectangular core cross-sections, with window clearances of 0.35" to make for a thin walled cylindrical cross-section opening into which encapsulant is poured for encapsulating the coil. A core of dimensions 0.32" by 0.38" may be easier to handle.

Figure 8A:
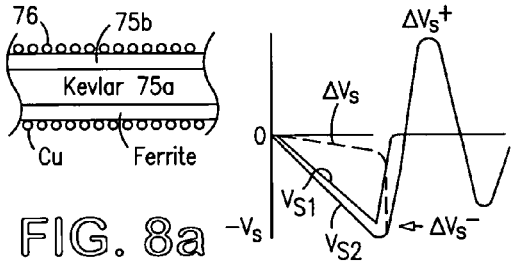
FIGS. 8*a* and 8*b* are partial, expanded side view drawings of cores with spiral windings making up inductive spark plug wire and their EMI suppressing capabilities in terms of the voltage swings that occur across the inductive wire when placed between the high voltage secondary winding of the ignition coil and the spark plug high voltage electrode.
Figure 8B:
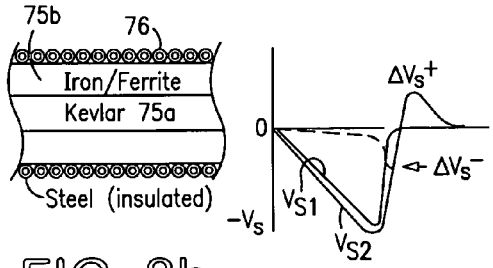

FIGS. 8*a* and 8*b* are partial, expanded side view drawings of the inside of inductive spark plug wires (excluding insulating jacket) with cores made up of a supporting structure 75*a*, such as Kevlar, and a magnetic coating 75*b*, surrounded by spiral wire windings 76. Associated with each drawing is its EMI suppressing capabilities in terms of the voltage swings that occur across the inductive wire when placed between the high voltage secondary winding of the ignition coil and the spark plug high voltage electrode.

FIG. 8*a* shows the inside of state-of-the-art wire with its ferrite coating whose thickness is typically approximately one half of the Kevlar diameter, and using fine copper wire for a relatively low resistance per foot, e.g. 10 to 50 ohms/foot preferred in the present application, and an inductance of about 100 uH/foot. Upon ignition firing, the voltage across the wire, ΔVs, indicated as the voltage difference between Vs1 and Vs2, the voltages at the two ends, has a negative difference ΔVs− and positive overshoot ΔVs+ equal to approximately the full output voltages Vs2, as indicated in the figure, for poor suppression capability.

For the same length of special suppression wire of FIG. 8*b*, the voltage ΔVs− is approximately ⅓ to ½ of Vs2, and the voltage ΔVs+ is approximately ⅓ of Vs2, which then decays at the first overshoot, versus oscillating in the case of the wire of FIG. 8*a*. The improved performance is achieved by several factors: first, by using a core made up of a combination of powder iron and ferrite, preferably ferrite that is lossy at 1 MHz, such as Fair-Rite 77, where the combination is at least 50% iron, determined by what can be tolerated without electrical shorting; secondly, by using a thicker coating, preferably equal to the diameter of the Kevlar, e.g. 0.025" Kevlar with approximately 0.025" or greater coating; thirdly, by using as thin a Kevlar as practical, so the overall OD is relatively small given the thick coating, e.g. preferably 0.02" Kevlar with 0.020" coating, for 0.06" OD, and relatively small inductance to resistance; and thirdly by using steel wire 76, i.e. high permeability magnetic steel wire for the winding, with a skin depth at least approximately ten times smaller than copper at 1 MHZ.

The gauge of steel wire to be used depends on the length of wire and allowable DC resistance. For example, forth case of very short wire of 1 to 2 inches, preferably 0.002" to 0.005" diameter wire is used, wound at approximately 40% to 60% fill factor, depending on application, for a DC resistance in the range of 10 to 30 ohms/inch, and an inductance of about 10 uH/inch. For spark plug wire in the one or more feet range, the wire diameter is preferably 0.006" to 0.012". By using insulated steel wire, a higher percent powder iron may be used which has both higher loss factor and lower permeability. Also, lower fill factor of approximately 30% may be used to increase the ration of resistance to inductance.

For a stand-alone inductor 70, larger thickness of coating may be used for the spark plug wire which is then inserted in a semi-rigid housing. However, an alternative is to use a thin cylinder, e.g. ⅙" to ⅛" of pressed particle core material such as made by TSC International (long, slightly insulated iron filings), and place a heavy coating of Fair-Rite 77, or a mixture of it and powder iron to provide insulation on the outside, and wind with a heavy insulated steel wire. Another alternative is a hollow ferrite core filled with particle core material. And other combinations are possible of lossy ferrite, powder iron, and particle core material for the composite lossy magnetic core material.

Figure 9:
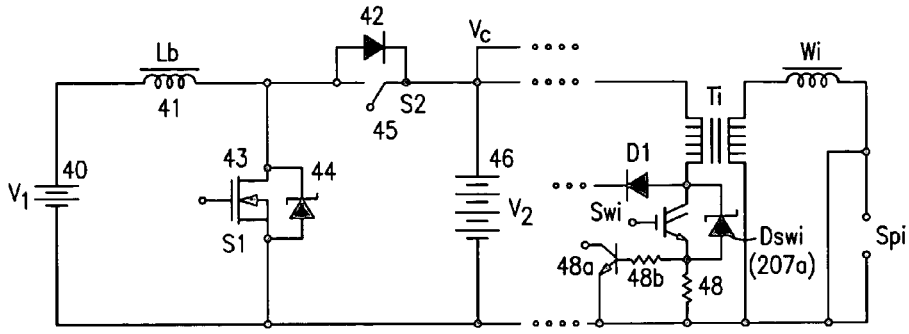
FIG. 9 is a partial circuit drawing of a simple form of high power bidirectional converter comprising a boost and buck converter, usable in automotive applications where a dual voltage rail is required.

In the present application, as mentioned, a simpler boost versus fly-back converter is preferred FIG. 9 is a partial circuit drawing of a simple form of high power bi-directional converter comprising a boost and buck converter, usable in automotive applications where a dual voltage rail is required. In the present case where a boost converter alone is required, switch S2 (45) is eliminated, with the boost converter is comprised of battery 40 of voltage V1, boost inductor Lb (41), boost output diode Db (42), FET switch S1 with shunt diode Dsh (44), and the battery V2 (46) replaced with capacitor 22 of FIG. 1*a*. Operation of this converter is well known to those versed in the art.

In the automotive application where 42 volts (or higher voltage) is available for the current preferred 42 volt (or higher) based ignition, a power converter may not be required. In that case, as shown on the right hand side of FIG. 9, separated by ellipses, switch Swi (IGBT shown) of coil Ti, has a current sense circuit with sense resistor 48 also acting as a fuse, with NPN sense transistor 48*a* (with base resistor 48*b*) turning on at the end of the coil current charging. In this case, if a switch Swi should become disabled by shorting (the sense resistor/fuse is opened due to excess current and heating), the other coils are still functioning and the engine can still operate in a "limp mode".

Figure 9A:
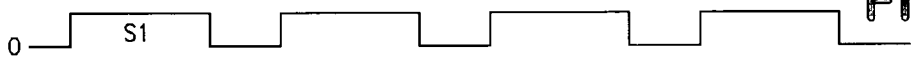
FIGS. 9*a* and 9*b* are the drive signals required to operate the converter in boost (step-up conversion) and buck (step-down conversion)
Figure 9B:
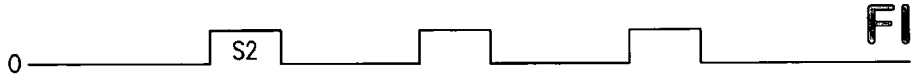
Figure 9C:
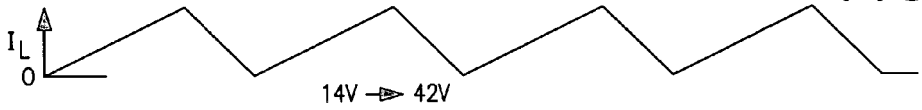
FIGS. 9*c* and 9*d* are the associated currents through the converter energy storage inductor.
Figure 9D:
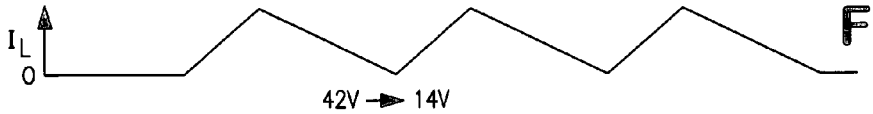

When used as a bidirectional converter for the automotive case, FIG. 9*a* depicts the control trigger signal applied to gate of N-type FET switch S1 for 14→42 volt up-converting (boosting), with the current through the inductor Lb shown in FIG. 9*c*, where the current charging high voltage battery V2 has half the period of the switch current S1 for the voltages V1 and V2 equal to 14 and 42 volts. For down-converting (bucking), FIGS. 9*b* and 9*d* show the trigger signals and subsequent current flows in the inductor Lb.

Figure 10:
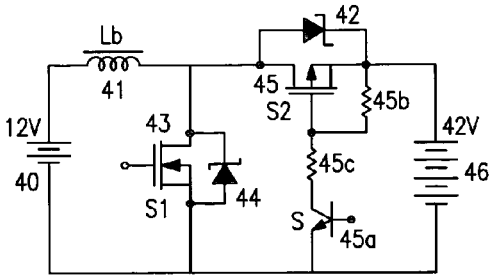
FIG. 10 is a simple form of the buck switch S2 of the converter of FIG. 9.

FIG. 10 depicts details of a possible buck switch S2 of FIG. 9, made up of a P-type FET which is easy to trigger but is not as efficient as an N-type for the same cost. For turn-off of the switch S2, its gate is pulled low by control transistor 45*a* through voltage divider 45*b* and 45*c* to apply a turn-on voltage (below 20 volts), as is know to those versed in the art. For a preferred N-type FET switch, a separate voltage above 42 volts is required, which can be produced by those versed in the art, e. g. by an extra winding on the inductor 41. The drive signals for the converter operation are given below the circuit drawing. Like numerals represent like parts with respect to FIG. 9.

Figure 11:
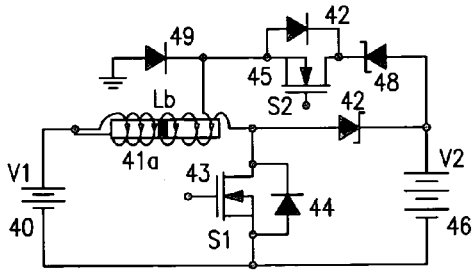
FIG. 11 is a novel form of the converter of FIG. 9 wherein a biasing magnet is used in the inductor made possible by using two identical windings on the core of the converter inductor.

FIG. 11 is a novel form of the converter of FIG. 9 wherein a biasing magnet is used in the inductor Lb (41*a*) made possible by using two identical in-phase windings on the core of the converter inductor connected together at the low-voltage end of the inductor winding and connected separately to the two ends of the switches S1 and S2, i.e. relative to the converter of FIG. 9, the down-converting circuit path from the high voltage V2 is separate from the up-converting path and includes an isolating diode Dis (48) in series with switch S2 (N-tpe FET shown). To the node between switch S2 and the winding is connected diode 49 with its anode to ground.

In operation, up-converting operates in the normal way. Down-converting operates by turning switch S2 on and off, with S1 switched off, except as a result the switch's separate winding, the magnetic flux in the core of the inductor Lb is in the same direction as in the down-converting case, which permits a biasing magnet to be used (preferably ferrite which also acts as the required air-gap). However, on the switch S2 turn-off, a separate diode 49 must be provided that is normally provided by diode 44. Like numerals represent like parts with respect to FIG. 9.

Figure 12:
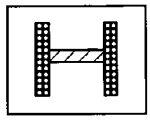
FIG. 12 is a side view of one of many possible designs of the inductor of the converter with biasing magnet at the center air-gap of the core center leg.

In this way, the magnetic core (preferably ferrite) can have a biasing magnet included, as shown in FIG. 12, representing a pair of E-cores with a gap in the center leg where the biasing magnet is located, and a small winding window for containing preferably one layer of each of the two windings. FIG. 12 is a side view of one of many possible designs of the inductor with biasing magnet which can reduce the core size by approximately 40%.

To summarize, the inventions disclosed herein, taken in part or as a whole, represent a significant improvement of the 42 volt based, low inductance, high ignition flow-coupling, coil-per-plug ignition system previously developed and patented by myself for application to lean burn and high EGR engines, to improve the size, flexibility, universatility and performance of the various parts making up the system, as well as its overall application for improved fuel economy and lower exhaust emissions.

The ignition ECU is improved by giving greater control and flexibility of the ignition to a low-cost MCU in terms of handling the charging of the ignition coils, as well as to their flexibility for charging during various conditions such as cold-start and hot operation. Also, the ability of the MCU to perform simultaneous ignition firing-and-sensing during cranking, and to use internal A/D conversion to find the minimum sense voltage (or maximum if the positive voltage is used following the typical initial negative breakdown voltage), makes the system easily retrofitable by not requiring a cam or phase reference signal.

More important for OEM use, the size and design of the ignition coils has been significantly improved by the use of biasing magnets to up to halve the size of the coils (in terms of the magnetic core area) for the same stored energy to allow for more flexible designs in terms of size and shape or greater, more universal application to spark ignition internal combustion engines. The coils have been made small enough, even for energies as high as the preferred 150 mJ, that they can be located on top of spark plugs by any of a number of methods known to those versed in the art, or near the spark plugs for more flexible and facile application.

In terms of EM, the system has been improved by the development of a special suppression inductors and spark plug wire with far greater suppressing abilities based on hybrid core material design (ferrite and iron) and wire winding (high permeability steel wire), to damp out EMI that might exist between the interconnections between the coil and plug, which can be aggravated by the use of the preferred high capacitance spark plugs which produce a more rapid breakdown of the spark gap (and hence higher EMI), as well as reduce the end-effect following such sharp spark breakdown.

In terms of igniting ability, the system has been improved by the development of a first practical capacitive spark plug with low cost metallization to produce the capacitance, which results in a rapid, high current breakdown spark known to improve the lean burn capability of an engine. The plug is especially versatile in construction, including a more practical form of halo-disc firing end design for offering long spark plug life and better igniting ability through better spark penetration and lower quenching electrodes through a practical convex firing end nose of less mass, coupled to a concave recessed insulator end which allows far better purging of the interior volume and cooling of the plug's high voltage tip by enabling use of a larger diameter cooling center conductor, and much higher capacitance within the threaded shell portion of the spark plug for even more rapid breakdown spark. The spark plug is easier to build in terms of all its features, including the preferred four slots which support the ground firing ring, and the sealing of the center electrode to the better thermal conductive copper cooling electrode, and other features. In terms of the engine design, the disclosed variable compression ratio (CR) not only has the usual advantages of permitting higher CR at light loads for greater efficiency, but in the case of the two-spark plug squish flow-coupled ignition system, it allows for much higher air-fuel ratio (leaner burn) at the higher compression ratios due to the higher degree of squish flow a the spark plug firing end site, e.g. 36 to 1 AFR at 14 to 1 CR, versus 30 to 1 AFR at 11 to 1 CR, for even greater engine efficiency and lower emissions. It also limits the peak pressure that the spark plugs sees at firing for less voltage stress on the spark plug and coil, and permits a more useful larger spark gap to be used. It also limits the engine peak pressures for overall lower stress while minimizing the chances of engine knock and allowing for lower octane fuel to be used.

As a complete system, there are other advantages that this ignition-engine system provides, especially in the form of more optimized combinations of the various features and components disclosed herein, including features and components disclosed elsewhere. Among the most important, as a complete engine system, in the form of the disclosed dual ignition Lean Burn Engine (with also high EGR capability), the system makes practical what we refer to herein as the "Lean Hybrid", which is the combination of this more optimized Lean Burn Engine married with a 42 volt based Mild Hybrid (which the ignition prefers) with its integrated starter-generator, to make for by far the most advanced and efficient future engine system, at a fraction of the cost all other future systems under consideration, especially the current very expensive and highly complex Full Hybrid.

Since certain changes may be made in the above apparatus and method, without departing from the scope of the invention herein disclosed, it is intended that all matter contained in the above description, or shown in the accompanying drawings, shall be interpreted in an illustrative and not limiting sense.

What is claimed is:

1. An inductive ignition system for an internal combustion engine operating at a voltage Vc substantially above the standard 12 volt automotive battery with one or more ignition coils Ti and associated power switches Swi, where i=1, 2, . . . n, with each coil having a primary winding of turns Np and inductance Lp, and a secondary high voltage winding for producing high voltage sparks of turns Ns and inductance Ls, the primary and secondary winding defining a turns ratio Nt equal to Ns/Np, the coils being of low inductance with one or more large air gaps within their magnetic core, and producing spark of peak current Is above 200 ma, the system further including means for providing the higher voltage Vc and controlling the charging and spark discharging of the ignition coils from said voltage Vc in a controlled sequential manner, and further including connection means for connecting the coil Ti secondary high voltage end to a sparking means which substantially reduces EMI following spark breakdown, the system further including electronic control means for receiving signals to fire the sparking means in their proper order, wherein a) each of the coils having an open-E type magnetic core with the open end located at the high voltage end and not having open ends at the other end of the core as in the case of pencil coils, and wherein two biasing magnets are placed in the open end of the core substantially filling the parallel two open ends or air-gaps, and having relatively higher inductance Lp than the pencil coils with two series gaps, and thus having fewer number of primary turns and satisfying the other features of the invention, i.e. biasing magnetic flux of up to 2 Tesla by use of high flux density biasing magnets;

b) the biasing magnets of each such coil have a length lm essentially filling the air-gap lw or w, the winding window, and cross-sectional area ½·Abias at right angles to the air-gap direction of the bias magnetic field Bbias, and the direction of the bias magnetic field Bbias is perpendicular to the direction of the magnetic core Bcore of the area ½·Acore at the intersection of the core and the bias magnets, and the ends of the center leg and the two side legs of the core which contain the biasing magnets form core leg E-sections which are of essentially uniform cross-section, c) the biasing magets have a cross-sectional area ½·Abias with one side of the two legs of thickness "t" essentially equal to the width or thickness of the core and another side along the length "z" of dimension h approximately equal to or larger than the other dimension of the side leg, i.e. ½·Abias=t·h, whereby the dimension h is free to be chosen such that the area Abias can be greater than the total core cross-section Acore such that:

(1) the bias magnetic flux density in the entire core can be as high as 2 Tesla with only one pair of bias magnets at one end versus 0.5 Tesla, and (2) the bias magnetic flux density in the entire core can be as high as 2 Tesla with only one pair of bias magnet at one end versus 1.5 Tesla with two magnets at both ends, d) the E-core is not a pencil type core but is a solid rectangular core including the biasing magnets at the open end, excluding the winding windows in which the primary winding and secondary winding are contained, e) and said open-E core with two biasing magnets located at the end of the core substantially resembles a closed E-core commonly found in automotive ignition coils, and whereby there is a reduction of the magnetic core area by approximately 40% for the same coil stored energy, to produce a system that as a whole is more versatile and smaller than prior such systems for the same high coil stored energy.

2. The ignition system of claim 1 wherein a micro-controller (MCU) is used for most of the electronic controls that includes generating the charge or dwell time Tch and steering such charging or energizing of the ignition coils in the proper sequence, and firing the spark plugs associated with such coils.

3. The ignition system of claim 2 wherein said micro-controller identifies the cylinder to be fired during engine cranking by sensing a voltage from a few turns of each coil by having all the coils fired simultaneously during cranking, and once identified, to then have the MCU shift to sequential firing with the proper firing order to run the engine.

4. The ignition system of claim 1 wherein the said coils have open-E type magnetic cores at the high voltage end wherein said biasing magnets are located and the core magnetic material is silicon iron.

5. The ignition system of claim 4 wherein the magnetic core of said coil is laminated of non-circular cross-section wherein two biasing magnet are used, one each at the core open ends.

6. The ignition system of claim 4 wherein said core is contained in a housing with the center core leg in the housing and the outer legs outside of the housing.

7. The ignition system of claim 4 wherein between the end of the high voltage winding of said coil and the high voltage connection of the sparking means is included a spiral winding of steel wire wound over a core of magnetic material which has a much higher resistance at and above 1 MHz relative to the DC resistance.

8. The ignition system of claim 1 wherein said connection means are spark plug wire with spiral winding of wire of high magnetic permeability over a core including magnetic material which exhibits high loss at 1 MHz or higher frequency relative to DC.

9. The ignition system of claim 1 wherein said sparking means are spark plugs with capacitance over 30 pF achieved by electroless chemical dip copper coating of the insulator surfaces.

10. The ignition system of claim 1 wherein said insulator is Alumina strengthened with approximately 20% or higher zirconia.

11. The ignition system of claim 9 wherein said spark plug has a halo-disc type firing end with recessed or concave high voltage insulator.

12. The ignition system of claim 11 wherein said firing end has a ground ring about the center high voltage electrode wherein said ring is held by four axial supports defining four slots through which air-fuel mixture can flow.

13. The ignition system of claim 12 wherein said axial supports define a cone with included angle θ between 30 and 90 degrees.

14. The ignition system of claim 9 wherein said spark plug has recessed firing end insulator with large diameter center conductor of diameter approximately 0.15" along the threaded spark plug shell section to provide higher capacitance than normal along this section.

15. The ignition system of claim 14 wherein said center conductor is high thermal conductivity material from the collection of copper, brass, and other high conductivity materials.

16. The ignition system of claim 1 wherein said switches Swi are IGBTs and wherein their gates are turned on slowly by including high value resistance in series with the gate to substantially reduce the output voltage overshoot upon switch Swi turn-on.

17. The ignition system of claim 1 including boost converter for raising said battery voltage Vb to a higher voltage Vc.

18. The ignition system of claim 1 wherein said boost converter is by-directional and includes two inductor windings with biasing magnet for the magnetic core.

19. The ignition system of claim 1 wherein higher values of winding wire are possible, wherein assuming a primary turns of 60 and secondary turns of 4,200, the primary inductance Lp of 500 uH is easily achievable, and a peak spark current of 350 ma, which is above 200 ma, and a peak primary current of Ip of approximately 25 amps and a coil stored energy of approximately 155 mJ.

20. The ignition system of claim 19 wherein the coil is an open-E coil with the open end at the high voltage end and wherein two biasing magnet are placed at the open ends and wherein the coil resembles a standard ignition coil.

21. The ignition system of claim 20 wherein said biasing magnets have magnetic flux densities of 1 Tesla or higher and the magnetic flux of the coil swings between approximately −1.6 Tesla and approximately +1.6 Tesla to provide a high energy density.

22. The ignition system of claim 21 wherein said switches Swi are 600 volt IGBTs and wherein their gates are turned on slowly by including high value resistance in series with the gate to substantially reduce the output voltage overshoot upon switch Swi turn-on.

23. An inductive ignition system for an internal combustion engine operating at a voltage Vc with one or more ignition coils Ti and associated power switches Swi, where i=1, 2, . . . n, with each coil having a primary winding of turns Np and inductance Lp, and a secondary high voltage winding for producing high voltage sparks of turns Ns and inductance Ls, the primary and secondary winding defining a turns ratio Nt equal to Ns/Np, the coils having an open-E core wherein two large air gaps are contained within the magnetic core, and producing spark of peak current Is above 200 ma because of the large air gaps and lower inductance, and further including connection means for connecting the coil Ti secondary high voltage end to a sparking means, the system further including electronic control means for receiving signals to fire the sparking means in their proper order, the system comprising two biasing magnets in said two air gaps in the magnetic core made up of cylindrical laminations comprising a rectangular core producing up to 2 Tesla bias to reduce the magnetic core area by approximately 40% for the same coil stored energy, to produce a system that as a whole is more versatile and smaller than systems for the same high coil stored energy without such feature.

24. The ignition system of claim 23 wherein said biasing magnets have magnetic flux densities of about 1 Tesla or higher and the magnetic flux of the coil swings between approximately −1.6 Tesla and approximately +1.6 Tesla to provide a high energy density.

25. The ignition system of claim 23 wherein the operating voltage Vc is between 24 and 60 volts.

26. The ignition system of claim 23 wherein the two biasing magnets of length lm span the space between the center core and the out core legs at the end of the core, designated as lw, where lm may be equal in length to lw, or slightly less than lw, and wherein the cross-section at right angles to the length lm is approximately equal to the total width of the laminations, and the other cross-sectional dimension, designated as the dimension h for height, is selected to accommodate the primary and secondary bobbins and to give a suitable magnetic flux density for each biasing magnet to produce a suitable average flux in each half of the core.

27. The ignition system of claim 26 wherein the length of the magnetic core lc is approximately 1.6" to approximately 2.0", and the biasing magnets height h is approximately 0.2".

28. An inductive ignition system for an internal combustion engine operating at a voltage Vc with one or more ignition coils Ti and associated power switches Swi, where i=1, 2, . . . n, with each coil having a primary winding of turns Np and inductance Lp, and a secondary high voltage winding for producing high voltage sparks of turns Ns and inductance Ls, the primary and secondary winding defining a turns ratio Nt equal to Ns/Np, the coils having a open-U core wherein one large air gap is contained within the magnetic core and able to produce spark of peak current Is above 200 ma because of the large air gap and lower inductance, and further including connection means for connecting the coil Ti secondary high voltage end to a sparking means, the system further including electronic control means for receiving signals to fire the sparking means in their proper order, the system comprising one biasing magnet in said air gap, wherein the biasing magnet spans essentially the air gap lw and has a cross-section approximately equal to the core thickness and a height h much less than the length lc of the magnetic core with minimum biasing greater than 1 Tesla versus 0.5 Tesla, to reduce the required magnetic core area for the same coil stored energy, to produce a system that as a whole is more versatile and smaller than prior such systems for the same high coil stored energy without such features.

* * * * *